US005545113A

United States Patent [19]

Bobich

[11] Patent Number: 5,545,113

[45] Date of Patent: Aug. 13, 1996

[54] COMBINATION ATHLETIC SHOE AND RESILIENT EXERCISE DEVICE

[76] Inventor: John L. Bobich, 3500 Magnums Way, No. 1, Redding, Calif. 96003

[21] Appl. No.: 415,844

[22] Filed: Apr. 3, 1995

[51] Int. Cl.[6] ..... A63B 21/02

[52] U.S. Cl. ..... 482/125; 482/74; 482/124; 482/139

[58] Field of Search ..... 482/124, 125, 482/105, 74, 121, 122, 114, 139

[56] References Cited

U.S. PATENT DOCUMENTS

| | | |
|---|---|---|
| 849,478 | 2/1907 | Muller . |
| 866,495 | 9/1907 | Marks . |
| 1,012,802 | 12/1911 | Brogan . |
| 1,618,273 | 2/1927 | Davidson . |
| 2,097,376 | 10/1937 | Marshman . |
| 2,498,006 | 2/1950 | Ridill . |
| 3,162,441 | 12/1964 | Karlik . |
| 3,529,820 | 9/1970 | Templeton . |
| 3,838,852 | 10/1974 | Gury . |
| 4,033,580 | 7/1977 | Paris . |
| 4,245,840 | 1/1981 | Van Housen . |
| 4,544,155 | 10/1985 | Wallenbrock et al. . |
| 4,852,874 | 8/1989 | Scheichter, III et al. . |
| 4,909,505 | 3/1990 | Tee . |
| 4,955,608 | 9/1990 | Dougherty et al. . |
| 5,137,272 | 8/1992 | Wilkinson . |
| 5,176,377 | 1/1993 | Wilkinson . |
| 5,186,701 | 2/1993 | Wilkinson . |
| 5,263,916 | 11/1993 | Bobich . |

*Primary Examiner*—Lynne A. Reichard
*Attorney, Agent, or Firm*—James M. Ritchey

[57] ABSTRACT

An exercise and physical therapy device having an adjustable length elongated resilient element with a wrist attachment strap at one end and a shoe attachment clip at the other end. The device is configured so that the shoe clip attaches to either the shoelace or an eyelet of the user's shoe, allowing the device to be used simultaneously while performing walking, running, or other exercises.

4 Claims, 4 Drawing Sheets

COMBINATION ATHLETIC SHOE AND RESILIENT EXERCISE DEVICE

BACKGROUND OF THE INVENTION

1. Field of the Invention

The invention related herein is a combination athletic shoe and resilient exercise and physical therapy device. Specifically, an exercise apparatus that can be worn by a user in association with an athletic shoe during physical therapy, walking, jogging, running, or other aerobic types of exercise is disclosed. The subject apparatus comprises, in combination with a typical athletic shoe, an elongated adjustable length, two ended resilient or elastic body element, with a releasable wrist attachment means at one end, and a releasable shoe attachment means at the other end. The shoe attachment means is adapted and configured to releasable attach to eyelets, shoestrings, or other suitable locations on the shoe. Usually, a pair of the resilient exercise devices are utilized by the user.

2. Description of the Background Art

A variety of tension-based resilient exercise devices have been devised in the past to meet a number of personal exercise and training requirements. However, the prior art has not addressed the need for a resilient exercise device that can be quickly attached to ordinary athletic shoes without the need of any additional straps or other securing elements.

U.S. Pat. No. 843,478 discloses a physical exerciser having a belt worn about the waist, and two elastic cords attached to the belt through guide rings. Both elastic cords have hand grips at one end, and foot harnesses at the other end.

Described in U.S. Pat. No. 866,495 is a similar exercising device with two elastic cords, each having hand grips at one end and a foot stirrup at the other end. The elastic cords are attached to a belt worn about the waist by guide rings that are on movable slides that can be positioned about the belt.

U.S. Pat. No. 1,012,802 presents an exercising device based on a non-elastic member having handles at each end. The handles are movable and can be adjusted to the user's outstretched arm span.

Related in U.S. Pat. No. 1,618,273 is a body exerciser having a waist encircling belt, a chest encircling belt, and two elastic members that run down the back of the user's leg to foot pieces. Two elastic members extend from the back of the chest encircling belt with hand grips on the ends, and are worn over the user's shoulders. Another elastic member extends from the back of the chest encircling belt to a head piece.

A device for training golfers is disclosed in U.S. Pat. No. 2,498,006, having an elongated resilient member with a wrist encircling element at one end and a heel attachment at the other end. The device is adjustable to apply resistance at the desired point of the user's golf stroke.

An exerciser is related in U.S. Pat. No. 2,097,376 in which various elastic cords are secured to the torso, arms, and feet of a user. The hands actively grasp the elements for exercising the arms.

U.S. Pat. No. 3,529,820 presents a bust development device having an elastic cord with elbow harnesses at each end. The device is worn behind the user's back.

U.S. Pat. No. 3,162,441 discloses a universal exerciser that has spring coupled pulleys that interact with a continuous cord that leads to the feet and hands.

Shown in U.S. Pat. No. 3,838,852 is an elastic type exercising device that has a two ended elastic member that extends into two flattened loops, one at each end of the member. During use, one or more of the elastic members may be interconnected.

An elastic type exercising apparatus is related in U.S. Pat. No. 4,033,580 having at least four elastic straps joined at a central junction at one end, and terminating in handles at the other end. The handles permit the user to grip more than one elastic strap at a time in order to increase the amount of tension during the exercise.

U.S. Pat. No. 4,245,840 discloses a resistive exercise device utilizing two elastic members having handles at one end and loops at the other end. The two elastic members are held together by an adjustable clip connector that can slide along the elastic members and vary the tension of the device.

An exercise device with a two ended stretchable elastomeric line is presented in U.S. Pat. No. 4,544,155. The elastic line is of fixed, unstretched length and has hooks at each end. The device is utilized to connect one body part of a user to a fixed object.

A portable isokinetic exercise device is described in U.S. Pat. No. 4,825,874 comprising an elastic loop having two handles and a central elastic retainer sleeve that contains the elastic loop between the handles.

A selectively connectable resilient exercise apparatus is presented in U.S. Pat. No. 4,909,505 having an resilient tube with a connectable hand grip and connectable foot strap. Additional resilient rings can be added to increase the resistance of the apparatus as the user increases strength.

U.S. Pat. No. 4,955,608 is an athletic movement trainer in which a two ended continuous elastic cord is fed through a ring mounted in a belt worn by the user. Each end of the cord is secured to an ankle of the user. The device reminds the user of correct posture.

Three different exercise devices are credited to Wilkinson. First, an exercise device for resistance walking is related in U.S. Pat. No. 5,137,272. The device has a waist band that is coupled to elastic cords that run to the hands and feet. The cord to the feet is configured as a "Y" with the single member attached to the band and each of the arms to an ankle or foot. Second, a coordinated arm-leg aerobic walking exercise device is seen in U.S. Pat. No. 5,176,377. A waist harness is fitted with a rigid but variable length and angle projection that includes a ring at its far end. Elastic or non-elastic cords are anchored to a users wrists and ankles. Each cord is fed through the guides in the harness and through the ring on the projection. Third, an aerobic resistance exercise garment is depicted in U.S. Pat. No. 5,186,701. Many variations are presented from simple wrist to ankle cord means to an entire body suit fitted with numerous rings and anchor points for associated cords.

U.S. Pat. No. 5,263,916, issued to the subject inventor, is directed to a resilient exercise device that is secured to a user's foot via a foot attachment strap. The foot attachment strap fits within the user's shoe and includes coupling rings for attaching a clip fitted to one end of a resilient cord. The subject invention improves upon the '916 device by permitting a user to quickly affix the resilient exercise device to standard athletic shoes without any additional components.

SUMMARY OF THE INVENTION

An object of the present invention is to provide a resistive resilient exercise device to enhance muscle development and physical fitness of the user.

More specifically, it is the object of the present invention to produce an resilient exercise device that can be worn leaving both hands and feet of the user free to engage in walking or running exercises while using the exercise device.

Another object of the present invention is to relate an resilient exercise apparatus that couple directly to most standard athletic shoes without the need of complex securing means.

A further object of the present invention is to provide a resilient exercise device having an elastic cord that is adjustable in length to permit one device to be used by individuals of varying physical size.

Disclosed is an exercise device to be employed by a user in combination with an athletic shoe, or pair of athletic shoes, with each shoe having a shoelace and a plurality of shoelace eyelets. Included in the subject invention is an elongated resilient element for each shoe. Each resilient member has a first end and a second end and a length adjustment means for altering the elongated element's length. Additionally, wrist attachment means are associated with the first end of each of the resilient elements. Each wrist attachment means is configured and structured to attach to a wrist of the user, usually via VELCRO interlocking surfaces. Further, the subject invention has means for securing the wrist attachment means to the first end of the elongated element and shoe attachment means associated with the second end of the resilient element that is configured and structured to releasably attach to either the shoelace or at least one of the shoelace eyelets. Ordinarily, the exerciser uses two resilient exercise devices simultaneously, with one device connecting the right wrist and right shoe, and the second device connecting the left wrist and left shoe.

Other objects, advantages, and novel features of the present invention will become apparent from the detailed description that follows, when considered in conjunction with the associated drawings.

DESCRIPTION OF THE PREFERRED EMBODIMENT

Figure 1:
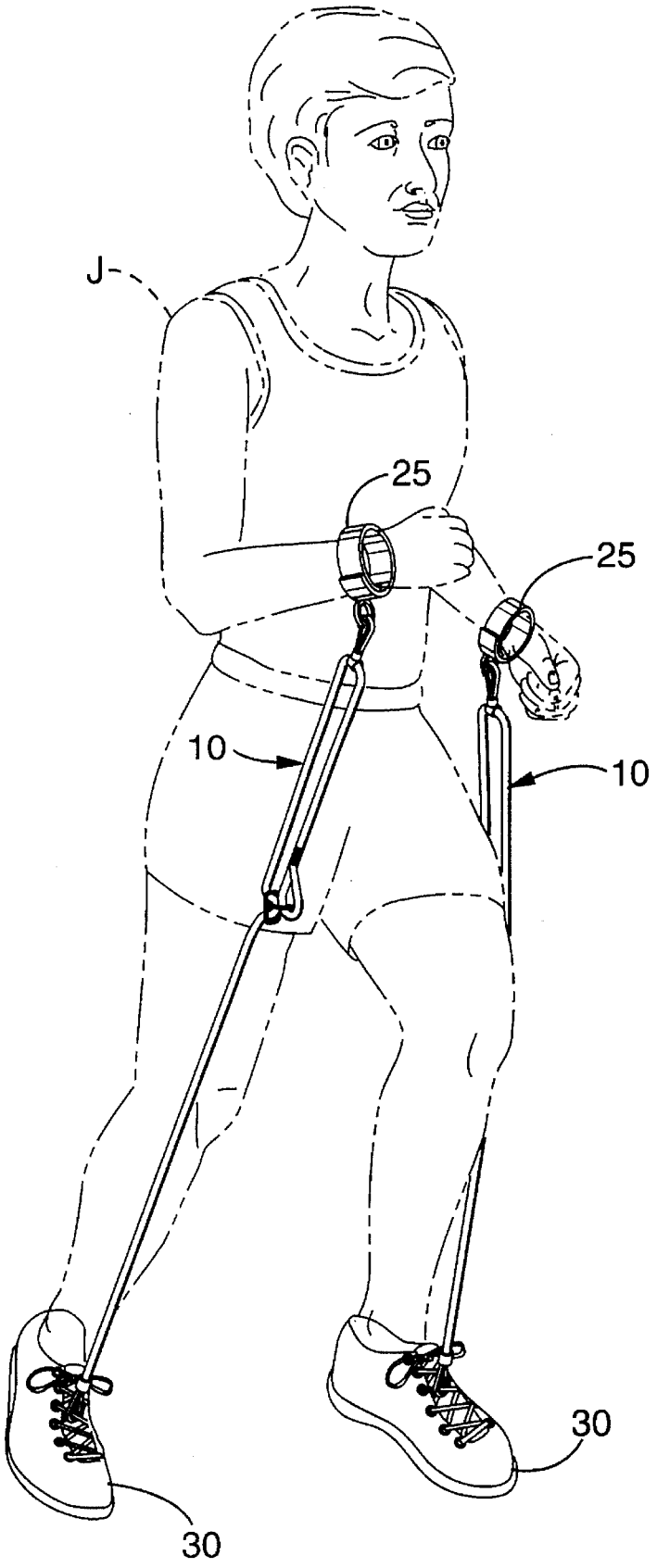
FIG. 1 is a perspective view of a preferred embodiment of the resilient exercise device in accordance with the invention disclosed herein as being utilized by a user to exercise.
Figure 2:
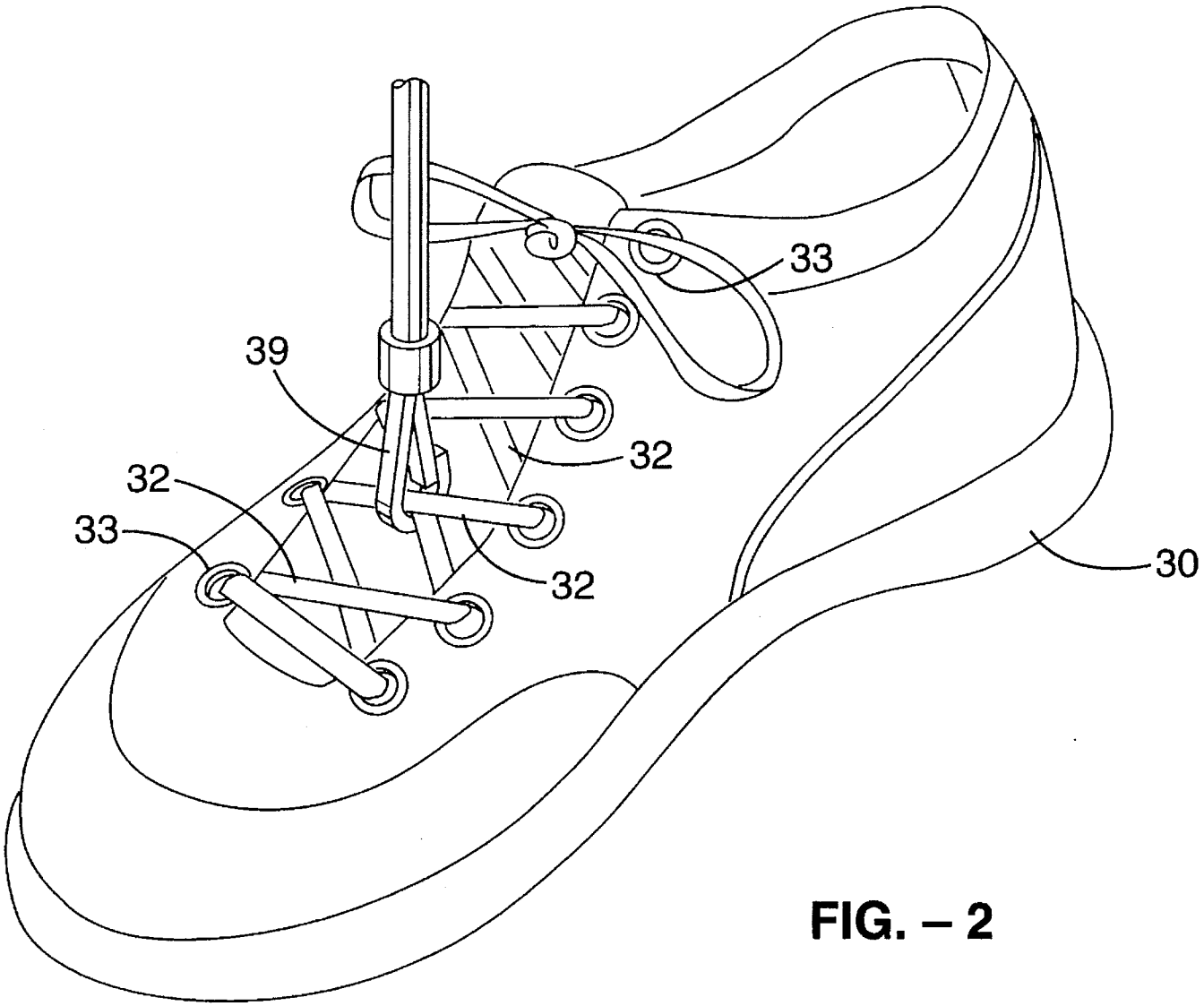
FIG. 2 is a perspective view illustrating the cord secured to the laces of the user's shoe.
Figure 3:
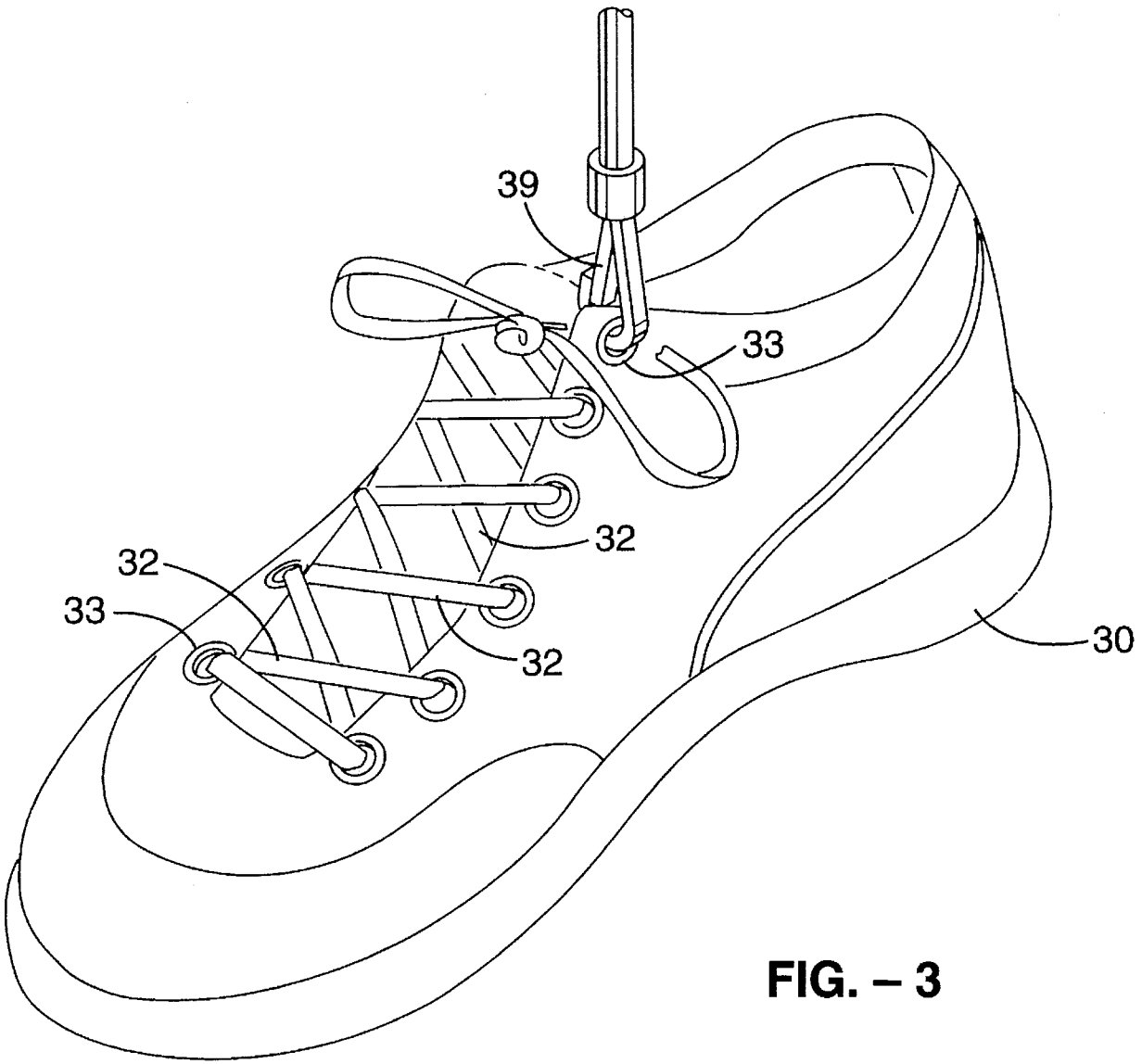
FIG. 3 is a perspective view illustrating the cord secured to an eyelet in the user's shoe.
Figure 4:
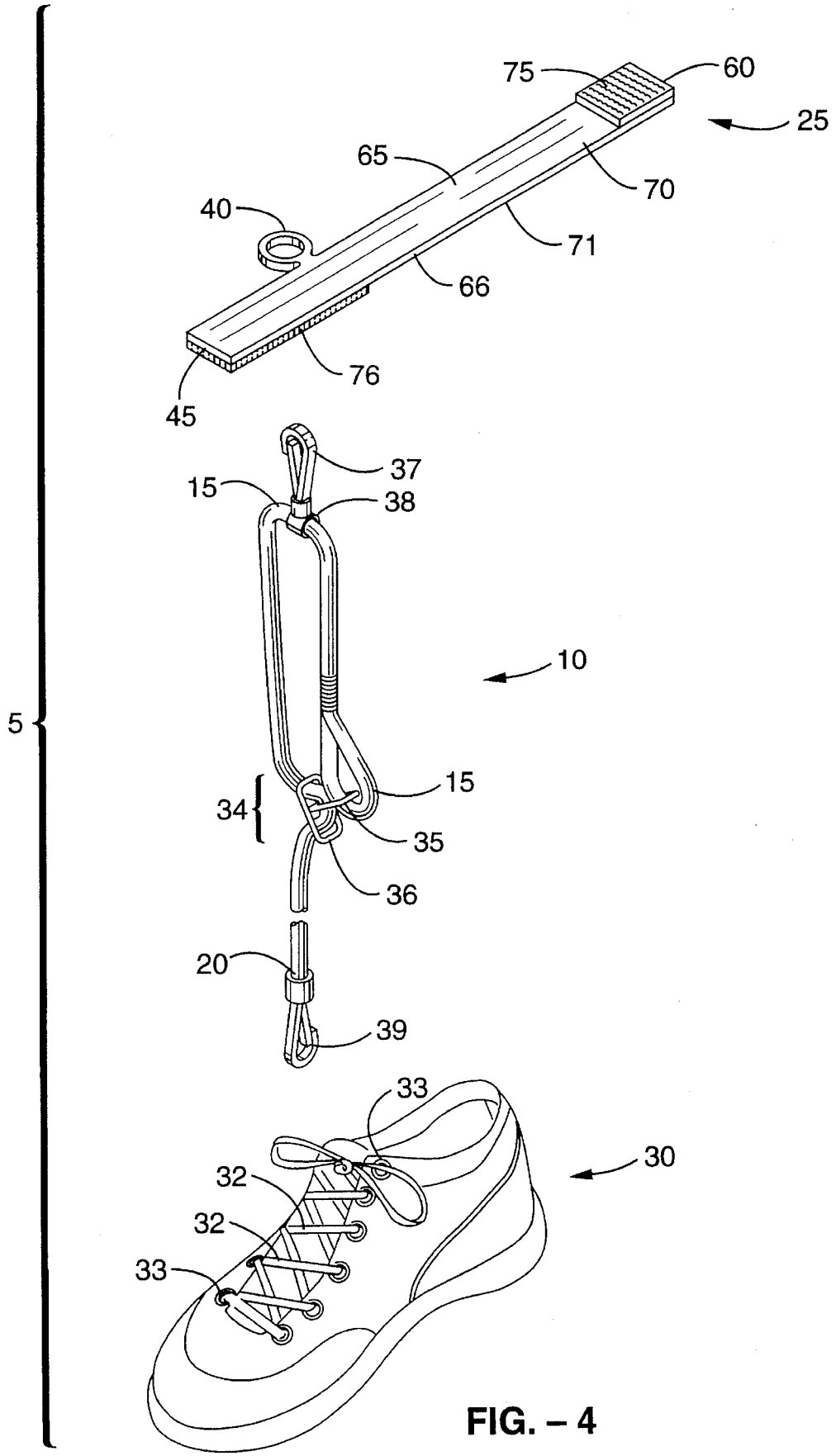
FIG. 4 is an exploded view of the subject invention.

Referring now to FIGS. 1–4, there is shown a preferred embodiment of an athletic shoe in combination with a resilient exercise and physical therapy device. Usually, a pair of athletic shoes fitted with the device is utilized by a user, exerciser, walker, or jogger J. The subject invention 5 comprises a resilient elongated element 10 with a length adjustment means. The elongated element has an effective first end 15 and an fixed second end 20. The exact location of the effective first end 15 within the entire length of the elongated element 10 varies depending upon the selected length of the adjusted elongated element 10 (see below for more details). Coupled to the resilient element is a wrist attachment means, preferably a flattened wrist strap 25, and coupled to the second elongated element end 20 is an athletic shoe attachment means or clip that is in turn releasably links or anchors to a typical athletic shoe 30 via the shoe's shoelaces 32 or one or more of a plurality of eyelets 33 for receiving the shoelace.

The elongated resilient element 10 is preferably a cord such as a BUNGEE cord, but may also be a suitably configured resilient tube, strap, spring, or spring that is housed in a resilient or non-resilient cylindrical housing.

To make the subject invention suitable for use by persons having different heights and to permit a user to adjust the amount of resistance provided by the elongated element 10 by shortening or lengthening the elongated resilient element 10, a length adjustment means is supplied. Although other equivalent length adjustment means are considered within the realm of this disclosure, preferably, the length adjusting means comprises a clamping buckle 34 linked via a first ring 35 to the first elongated element end 15 by standard techniques such as forming a securing loop, gluing, stitching, melting, clamping, or equivalent methods. The preferred clamping buckle 34 of the length adjusting means comprises, in addition to the first ring 35, a second ring 36 through which the elongated element 10 passes (see FIG. 4 for details). The user alters the location of the adjusting means to his or her particular needs and when the elongated element 10 is stretched the first 35 and second 36 rings cooperate to pinch the elongated element 10, thereby locking its overall effective length to the selected span.

Means are provided for securing the wrist attachment means to the elongated element 10. Preferably, a releasable clip 37 and a third ring 38 comprise the wrist attachment means. The elongated member 10 slides through the third ring 38, thereby allowing the clip 37 to be situated at the effective first end 15 of the elongated element 10, or actually, in a length adjusted loop of elongated element 10 generated by the length adjusting means.

Means for attaching the wrist strap 25 to the reversible attaching clip 37 is preferably via a ring 40 which inserts into the clip 37. The reversible clip 37 is fastened to the resilient element effective first end 15, and the ring 40 is fastened to the wrist strap first end 45. It is understood, however, that equivalent reversible attachment means such as clamps, buttons, zippers, VELCRO, or other similar means of attachment are contemplated as within the scope of this disclosure.

The wrist attachment means of the subject invention is preferably a flattened wrist strap 25, having a first end 45 and a second end 60, two side edges 65 and 66, and two flat surfaces 70 and 71. Generally the wrist strap 25 is made of fabric, leather, or suitable natural or synthetic polymers. In the embodiment shown in FIGS. 1 and 4, a ring 40, which fits the reversible clip 37, is attached to the wrist strap side edges 65 and 66 adjacent the wrist strap first end 45. However, the ring 40 may be attached to the wrist strap first end 45 or to the wrist strap flat surfaces 70 and 71 as well the wrist strap side edges 65 and 66. Preferably, VELCRO fasteners 75 on the wrist strap flat surfaces 70 and 71 allow for reversible attachment to the user's J wrist. Other fastening means such as buttons, zippers, clips, laces, or cords are also contemplated here. A cinch or other adjusting method may be used to control the length of the wrist strap 25. It should be readily understood that wrist attachment means other than a strap, such as a resilient or non-resilient tubes, bands, or bracelets are also considered as within the realm of the subject invention.

The athletic shoe 30 is of standard construction that includes at least a coupling region for securing the elongated element 10. Usually, the coupling region comprises shoelace eyelets and shoelaces, however, some athletic shoes utilize straps, buckles, zippers, and other equivalent means for holding the shoe 30 to a user's foot and these are also suitable for serving as regions for coupling the elongated element 10. Preferably, as seen in FIG. 1 and more specifically in FIGS. 2 and 3, the coupling region is either the actual shoelaces 32 (see FIGS. 1 and 2) or one or more shoelace eyelets 33 (see FIG. 3). Thus, the form of the clip 39 must be such that is capable of releasably linking with these coupling regions.

Generally, the exerciser J will wear two of the resilient exercise devices 5 at the same time, with one device connecting the right wrist and right shoe, and the second device connecting the left wrist and left shoe. If desired, the user J can attach or clip both devices together to minimize any interference between the resilient elements 10 of the two devices. In addition to exercise, the subject invention is employed in physical therapy after an accident or inactivity by the user J to aid in reestablishing cross crawl developmental processes.

As the exerciser gains in strength while using the resilient exercise device, the resilient members can be uncoupled from the wrist and shoe and replaced by a more resistive resilient member to allow further muscle development. Further, adjustable resistance elongated elements are contemplated as being within the realm of this disclosure.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An exercise device to be employed by a user in combination with an athletic shoe, comprising:

a) an athletic shoe configured and structured to have at least one coupling point;

b) a coupling region on said athletic shoe;

c) an elongated resilient element having a first end and a second end, wherein said elongated resilient element further comprises a clamping buckle associated with said first elongated resilient element end for adjusting said elongated resilient element's length, wherein said clamping buckle comprises:

a first ring linked to said elongated resilient element first end and a second ring secured to said first ring and through which said elongated resilient element passes, whereby said first and said second rings cooperate to pinch said elongated resilient element thereby locking its overall length to a selected span;

d) a wrist attachment strap associated with said elongated resilient element that is configured and structured to attach to a wrist of the user;

e) means for securing said wrist attachment strap to said elongated resilient element; and f) shoe attachment means associated with said second end of said elongated resilient element that is configured and structured to releasably attach to said athletic shoe coupling region.

2. An exercise device to be employed by a user in combination with an athletic shoe, comprising:

a) an athletic shoe having a shoelace and a plurality of shoelace eyelets;

b) an elongated resilient element having a first end and a second end;

c) a clamping buckle associated with said first elongated resilient element end for adjusting said elongated resilient element's length, wherein said clamping buckle comprises:

a first ring linked to said elongated resilient element first end and;

a second ring secured to said first ring and through which said elongated resilient element passes, whereby said first and said second rings cooperate to pinch said elongated resilient element thereby locking its overall length to a selected span;

d) a wrist attachment strap that is configured and structured to attach to a wrist of the user;

e) means for securing said wrist attachment strap to said elongated resilient element; and f) shoe attachment means associated with said second end of said elongated resilient element that is configured and structured to releasably attach to either said shoelace or at least one of said shoelace eyelets.

3. An exercise device to be employed by a user in combination with a pair of athletic shoes, comprising:

a) a pair of athletic shoes with each shoe having a shoelace and a plurality of shoelace eyelets;

b) a pair of elongated resilient elements with each of said elongated resilient elements having a first end and a second end, wherein each of said elongated resilient elements further comprises a clamping buckle associated with said first elongated resilient element end for adjusting said elongated resilient element's length, wherein said clamping buckle comprises:

a first ring linked to said elongated resilient element first end and a second ring secured to said first ring and through which said elongated resilient element passes, whereby said first and said second rings cooperate to pinch said elongated resilient element thereby locking its overall length to a selected span;

c) a wrist attachment strap associated with each of said elongated resilient elements that is configured and structured to attach to a wrist of the user;

d) means for securing said wrist attachment strap to said elongated resilient element; and e) shoe attachment means associated with said second end of each of said elongated resilient elements that is configured and structured to releasably attach to either said shoelace or at least one of said shoelace eyelets.

4. An exercise device to be employed by a user in combination with a pair of athletic shoes, comprising:

a) a pair of athletic shoes with each shoe having a shoelace and a plurality of shoelace eyelets;

b) a pair of elongated resilient elements with each of said elongated resilient elements having a first end and a second end;

c) a clamping buckle associated with said first elongated resilient element end for adjusting said elongated resilient element's length, wherein said clamping buckle comprises:

a first ring linked to said elongated resilient element first end and;

a second ring secured to said first ring and through which said elongated resilient element passes, whereby said first and said second rings cooperate to pinch said elongated resilient element thereby locking its overall length to a selected span;

d) a wrist attachment strap associated with each of said elongated resilient elements that is configured and structured to attach to a wrist of the user;

e) means for securing said wrist attachment strap to said elongated resilient element; and f) shoe attachment means associated with said second end of each of said elongated resilient elements that is configured and structured to releasably attach to either said shoelace or at least one of said shoelace eyelets.

* * * * *